United States Patent [19]

Orlandi

[11] 4,296,688

[45] Oct. 27, 1981

[54] ELECTRIC CIRCUIT FOR FIRING A DETONATOR

[75] Inventor: Robert G. Orlandi, Prilly, Switzerland

[73] Assignee: S.A. PRB Societe Anonyme, Brussels, Belgium

[21] Appl. No.: 72,100

[22] Filed: Sep. 4, 1979

[30] Foreign Application Priority Data

Sep. 5, 1978 [CH] Switzerland ..... 9329/78

[51] Int. Cl.[3] ..... F42C 11/06

[52] U.S. Cl. ..... 102/218

[58] Field of Search ..... 102/220, 219, 218, 209, 102/206

[56] References Cited

U.S. PATENT DOCUMENTS 3,045,148 7/1962 McNulty et al. ..... 102/218

FOREIGN PATENT DOCUMENTS 1948382 4/1971 Fed. Rep. of Germany ..... 102/219
2152427 2/1977 Fed. Rep. of Germany ..... 102/218
1048627 11/1966 United Kingdom ..... 102/219

*Primary Examiner*—Charles T. Jordan
*Attorney, Agent, or Firm*—Bacon & Thomas

[57] ABSTRACT

Electric circuit for firing a detonator for a projectile, comprising a generator for charging a first condenser and a second condenser connected in series, the aforesaid first condenser being connected in series with a contactor, a primer and a semi-conductor component with a controlled conductibility, and means for stabilizing the voltage of one of the aforesaid condensers and for preventing the firing of the primer during a predetermined time, in which the aforesaid means comprise a first voltage divider connected in parallel with the series connection of the aforesaid first condenser and second condenser and aforesaid contactor, the control electrode of the aforesaid semi-conductor component being connected with the intermediate point of the aforesaid first voltage divider comprising a transistor, the base of which is connected with the intermediate point of a second voltage divider connected in parallel with the aforesaid second condenser, the capacity of which is many times greater than the capacity of the first condenser.

3 Claims, 2 Drawing Figures

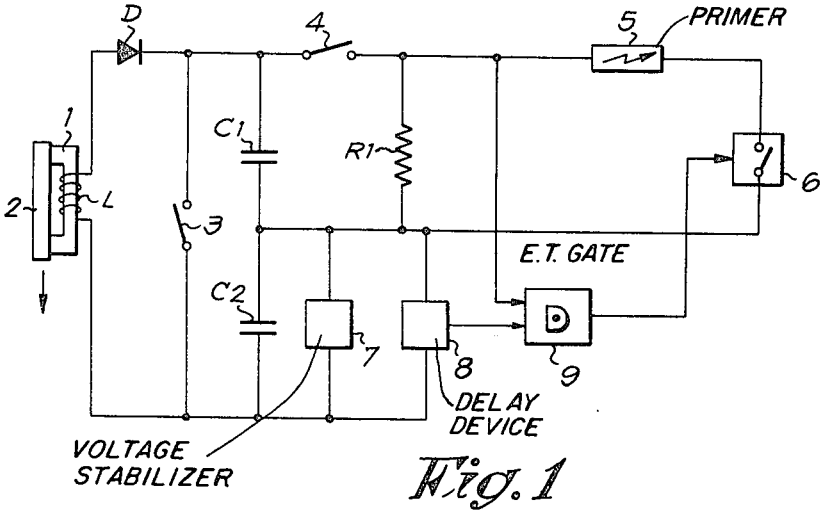
Fig. 1
Fig. 2
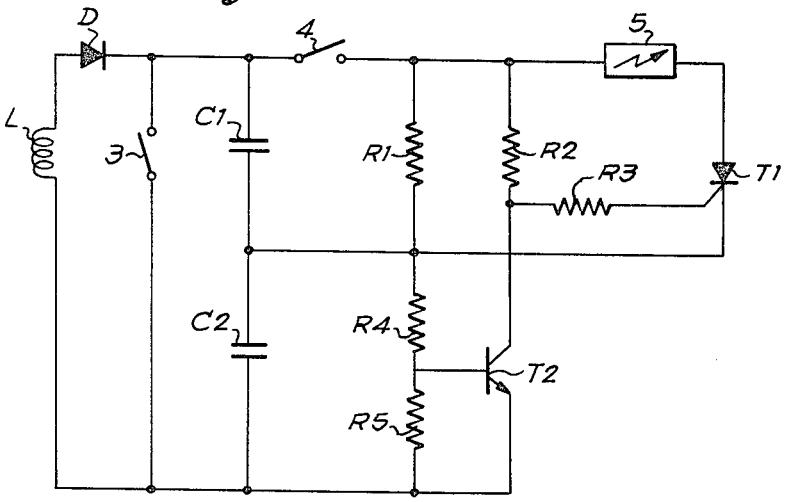

ELECTRIC CIRCUIT FOR FIRING A DETONATOR

BACKGROUND OF THE INVENTION

The present invention relates to an electric circuit for firing a detonator for a projectile, comprising a generator for charging a first condenser and a second condenser which are connected in series, the aforesaid first condenser being connected in series with a contactor, a primer and a semi-conductor component with controlled conductibility, and means for stabilizing the voltage of one of the aforesaid condensers and to prevent the firing of the primer during a predetermined time.

Such an electric circuit is of the type disclosed in DOS No 1.948.382. In this known circuit, the aforesaid means stabilize the voltage on the first condenser by using a Zener diode and prevent the firing of the primer during a predetermined time after closing the contactor.

SUMMARY OF THE INVENTION

The object of the present patent application is to provide an electric circuit of the aforesaid type, but in which the aforesaid means do not use a Zener diode, however also preventing the firing of the primer during a predetermined time after the condensers have been charged.

According to the invention, the object is achieved in that the aforesaid means comprise a first voltage divider connected in parallel with the connection in series of the aforesaid first condenser and second condenser and of the aforesaid contactor, the control electrode of the aforesaid semi-conductor component being connected with the intermediate point of the aforesaid first voltage divider, comprising a transistor, the base of which is connected in parallel with the aforesaid second condenser, which has, a value many times greater than the value of the first condenser.

So, the said means do not only stabilize the voltage of the second condenser without using a Zener diode, but they also prevent the firing of the primer during a predetermined time after charging the condensers.

BRIEF DESCRIPTION OF THE DRAWINGS

The attached drawing shows schematically and as an example an embodiment of the circuit according to the invention.

FIG. 1 is a box diagram of a circuit embodying the present invention.

FIG. 2 shows the details of a preferred form of the invention as shown in FIG. 1.

DESCRIPTION OF THE PREFERRED EMBODIMENTS

With reference to FIG. 1, the circuit comprises a generator consisting of a winding L wound around a magnetic core, a part 1 of which is made from soft iron and a part 2 of which is a permanent magnet, the latter being intended for becoming separated from part 1 when the shot is being fired. In a general way of speaking, this motion is simply obtained through inertia, the removal of the permanent magnet 2 producing a sudden variation of the magnetic flux in winding L, which induces an electric voltage used for charging two condensers C1 and C2 connected in series.

A diode D prevents the condensers from discharging again in winding L after having been charged. A switch 3 short-circuits the two condensers, before the firing of the shot takes place, for avoiding any difference in potential due, for instance, to parasitic electrical fields.

Condenser $C_1$ feeds in series a contactor 4 for controlling the firing, a primer 5 and an electronic switch 6.

Condenser $C_2$ is connected with a voltage stabilizing device 7 and a delaying device 8. The latter acts on a circuit 9, which works as an ET gate and supplies the control signal for closing the electronic switch 6.

When the shot is fired, both condensers $C_1$ and $C_2$ are charged, condenser $C_1$ being provided for supplying the energy required for firing the primer 5. Condenser $C_2$ feeds the delaying device 8 preventing, by means of circuit 9, a signal from closing the switch 6 during a certain time after the condensers have been charged. This delay time can, for instance, be of about 100 ms and allows for the muzzle safety. The delay achieved by circuit 8 is constant, thanks to the voltage stabilizer 7 allowing for a charging voltage of condenser $C_2$ that is independent of the voltage supplied by the generator. The latter voltage may, indeed, vary in an appreciable way as a function of the initial acceleration of the projectile and, thus, of the speed of the motion of the permanent magnet. Should firing contactor 4 close accidentally before the end of the muzzle safety, condenser $C_1$ would discharge itself through a resistance $R_1$ and thus become discharged, preventing any subsequent firing.

FIG. 2 shows a specially advantageous embodiment of the circuit according to FIG. 1. This winding L of the generator, diode D, switch 3, condensers $C_1$ and $C_2$, resistance $R_1$, contactor 4 and primer 5 are to be found here again.

The electronic switch consists of a thyristor $T_1$, the control electrode of which is connected through a resistance $R_3$ with a voltage divider consisting of a resistance $R_2$ and transistor $T_2$. This voltage divider is connected with the terminals of the two condensers $C_1$ and $C_2$ mounted in series.

The base of transistor $T_2$ is controlled by a signal obtained by means of a second voltage divider, consisting of two resistances $R_4$ and $R_5$ connected with the terminals of condenser $C_2$.

The circuit works as follows:

When the charge of condensers $C_1$ and $C_2$ is started, transistor $T_2$ becomes conducting as soon as the voltage drop in resistance $R_5$ attains the value, mostly 0,6 V, which is needed for bringing this transistor to a state of saturation. Thus, at this time, the voltage on condenser $C_1$ is much too low to allow the firing of the primer 5 which, as a rule, is of a spark-gap type. As soon as transistor $T_2$ becomes conducting, the control electrode of thyristor $T_1$ is made negative in relation to its cathode, which excludes any possibility of this thyristor being conducting.

The muzzle safety is provided through the discharge of condenser $C_2$ through resistance $R_4$ and transistor $T_2$, until the base voltage of the latter becomes too low for maintaining same in a conducting state. As soon as this condition is fulfilled, the control electrode of thyristor $T_1$ is apt to receive the positive potential of condensor $C_1$ which is transmitted through resistance $R_2$.

The circuit described allows, at a small cost, a stabilization of the voltage on condenser $C_2$, thanks to the Zener effect which is to be observed between the cathode and control electrode of the thyristor. As a matter of fact, as soon as the positive voltage on the cathode in relation to the control electrode becomes higher than a predetermined value, about 10 V, the passage of a current is to be observed, which gives a discharge current of condenser $C_2$ through the circuit consisting of the cathode of $T_1$, the control electrode of same, resistance $R_3$, and transistor $T_2$. In this way, the maximum voltage of $C_2$ is being limited, so that its discharge time is constant until the time at which $T_2$ becomes non-conducting.

Furthermore, the safety due to the discharge of condenser $C_1$ through resistance $R_1$ in case of an accidental too early closure of contactor 4 is obtained in the same way as described above with reference to FIG. 1.

As far as the diagram of FIG. 2 is concerned, it should be noted that the control voltage of transistor $T_2$ is much lower than the voltage required for firing primer 5, so that it is advantageous to provide a condenser $C_2$ having a capacity that is many times greater than the capacity of condenser $C_1$.

What we claim is:

1. Electric circuit for firing a detonator for a projectile, comprising a generator for charging a first condenser and a second condenser connected in series, the aforesaid first condenser being connected in series with a contactor, a primer and a semi-conductor component with a controlled conductibility, and means for stabilizing the voltage of one of the aforesaid condensers and for preventing the firing of the primer during a predetermined time, in which the aforesaid means comprise a first voltage divider connected in parallel with the series connection of the aforesaid first condenser and second condenser and aforesaid contactor, the control electrode of the aforesaid semi-conductor component being connected with the intermediate point of the aforesaid first voltage divider comprising a resistor and a transistor, the base of which is connected with the intermediate point of a second voltage divider connected in parallel with the aforesaid second condenser, the capacity of which is many times greater than the capacity of the first condenser.

2. Electric circuit according to claim 1, in which means are provided for discharging the first condenser in case of a premature closure of the contactor.

3. Electric circuit according to claim 2, in which the said means for discharging comprise a resistance connected with the first condenser, in series with the contactor.

* * * * *